US011753753B2

(12) United States Patent
Myogi et al.

(10) Patent No.: US 11,753,753 B2
(45) **Date of Patent: *Sep. 12, 2023**

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 74 days.

This patent is subject to a terminal disclaimer.

(21) Appl. No.: 17/333,895

(22) Filed: May 28, 2021

(65) Prior Publication Data

US 2021/0381139 A1 Dec. 9, 2021

(30) Foreign Application Priority Data

Jun. 4, 2020 (JP) ..... 2020-097695

(51) Int. Cl.
*D03D 51/02* (2006.01)
*D03D 49/02* (2006.01)
(Continued)

(52) U.S. Cl.
CPC ..... *D03D 51/02* (2013.01); *D03D 49/02* (2013.01); *D03D 51/06* (2013.01)

(58) Field of Classification Search
CPC ..... D03D 47/275; D03D 49/02; D03D 51/02; D03D 51/00; D03D 49/60; D03D 49/62; D03D 51/007
See application file for complete search history.

(56) References Cited

U.S. PATENT DOCUMENTS 983,550 A * 2/1911 Harrington ..... D03D 47/24 139/438
2,522,629 A * 9/1950 Mastriani ..... D03D 51/28 139/357
(Continued)

FOREIGN PATENT DOCUMENTS

CN 206345969 U 7/2017
EP 1245707 A1 10/2002
(Continued)

OTHER PUBLICATIONS https://www.textileschool.com/361/weaving-machine-basic-operations/#:~:text=Shedding%20is%20automatically%20performed%20by%20the%20harness%20on,it%20passes%20through%20an%20opening%20in%20the%20heddle; "Weaving machine basic operations"; Mar. 2018; whole document accessed Apr. 3, 2023 (Year: 2018).*
(Continued)

*Primary Examiner* — Robert H Muromoto, Jr.
(74) *Attorney, Agent, or Firm* — Paratus Law Group, PLLC

(57) ABSTRACT

A driving-force transmission mechanism includes a driving-force transmission shaft that is provided so as to protrude from a side wall of a side frame while extending parallel to a driving shaft 30 within a space of the side frame, the driving-force transmission shall being connected to a driving motor, and to which an opening device is connected, and a transmission mechanism that connects the driving-force transmission shaft and the driving shaft, and a braking device is connected to the driving-force transmission shaft.

1 Claim, 2 Drawing Sheets

(51) Int. Cl.
*D03D 51/06* (2006.01)
*D03D 49/00* (2006.01)

(56) References Cited

U.S. PATENT DOCUMENTS 2,561,416 A * 7/1951 Robinson ..... D03D 47/44 139/432
2,582,761 A * 1/1952 Shertz ..... D03D 49/24 139/145
2,791,242 A * 5/1957 Cashion ..... D03D 49/70 139/303
2,889,855 A * 6/1959 Turner ..... D03D 51/02 139/336
3,400,423 A * 9/1968 Black, Jr. ..... D03J 1/002 15/312.1
3,441,058 A * 4/1969 Bassing ..... D03D 51/02 139/1 R
3,459,237 A * 8/1969 Xaus ..... D03C 1/144 139/89
3,460,660 A * 8/1969 Barrowclough ..... A47B 81/007 193/27
4,387,741 A * 6/1983 Palau ..... D03C 1/00 139/66 R
4,570,683 A * 2/1986 Griffith ..... D03D 47/00 139/194
4,850,399 A * 7/1989 Linka ..... D03D 47/361 139/50
5,007,464 A * 4/1991 Gorris ..... D03D 47/363 66/219
5,020,573 A * 6/1991 Debaes ..... D03D 47/38 139/453
5,259,420 A * 11/1993 Foster ..... D03D 49/06 242/598.5
5,313,988 A 5/1994 Bilcke et al.
5,411,064 A * 5/1995 Yamagishi ..... D03D 47/06 139/432
5,423,354 A * 6/1995 Herrlein ..... D03D 39/226 139/26
6,247,503 B1 * 6/2001 Shaw ..... D03D 51/02 139/1 R
7,478,997 B2 * 1/2009 Ishida ..... F04B 39/126 417/372
2004/0226257 A1 * 11/2004 Jaeger ..... B23Q 1/01 52/749.1
2007/0220925 A1 * 9/2007 Lonati ..... D04B 27/08 66/204
2009/0088035 A1 * 4/2009 Gonzalez ..... B63H 16/12 440/105
2019/0145658 A1 * 5/2019 Hodgkinson ..... B05B 7/22 392/478
2021/0332508 A1 * 10/2021 Myogi ..... D03D 49/02
2021/0381137 A1 * 12/2021 Myogi ..... D03D 47/275
2021/0381138 A1 * 12/2021 Myogi ..... D03D 49/62
2021/0381139 A1 * 12/2021 Myogi ..... D03D 51/02
2022/0098765 A1 * 3/2022 Myogi ..... D03C 9/02
2022/0098766 A1 * 3/2022 Myogi ..... D03D 49/02
2022/0160148 A1 * 5/2022 Tegel ..... A47F 7/0243
2022/0195641 A1 * 6/2022 Porte ..... D03C 3/20

FOREIGN PATENT DOCUMENTS

EP 1600542 A2 11/2005
JP H05-156551 A 6/1993
JP 2004-107838 A 4/2004

OTHER PUBLICATIONS

Oct. 19, 2021, European Search Report issued for related EP Application No. 21176608.4.
May 11, 2023, Indian Office Action issued for related IN Application No. 202144023816.

* cited by examiner

LOOM

CROSS-REFERENCE TO RELATED APPLICATION

The present application claims priority from Japanese Patent Application No. 2020-097695, filed on Jun. 4, 2020, the entire subject matter of which is incorporated herein by reference.

BACKGROUND OF THE INVENTION

Field of the Invention

The present invention relates to a loom including a driving shaft to which a main shaft of the loom is connected and to which a swing shaft for driving a reed to swing is connected via a swing mechanism, a driving motor to which the driving shaft is connected via a driving-force transmission mechanism to rotationally drive the driving shaft, an opening device that is driven by the driving motor, a braking device that applies a brake to the main shaft, and a side frame that accommodates the driving shaft and the swing shaft in an orientation in which each axial direction of the driving shaft and the swing shaft matches with a width direction.

Background Art

A loom has a shaft (driving shaft) of which one end is connected a main shaft and which is rotationally driven by a driving motor. In a general loom, the driving shaft is accommodated in one of a pair of side frames in a frame of the loom. The driving shaft is rotationally driven by the driving motor, so that the main shaft connected to the driving shaft is rotationally driven. The rotation of the driving shaft is also driving the reed to swing. Specifically, a swing shaft for driving the reed to swing is also accommodated in the one side frame, and the swing shaft is connected to the driving shaft via a swing mechanism such as a cam mechanism and a crank mechanism. As described above, the loom is configured such that the swing shaft is swing-driven as the driving shaft is rotationally driven, whereby the reed is driven to swing.

As described above, the configuration (driving-force transmission mechanism) that connects the driving shaft and the driving motor for rotationally driving the driving shaft by the driving motor is disclosed in JP-A-H5-156551. In a configuration that is disclosed in JP-A-H5-156551 (hereinafter, referred to as the "configuration of the related art"), an intermediate shaft, which is connected to the driving motor by a pulley and a timing belt, is provided between the driving shaft to which a swing mechanism is connected and the driving motor. The intermediate shaft and the driving shaft are connected by a gear train.

The loom includes an opening device that displaces a heddle frame in a vertical direction in order to give an opening motion to the warps. The opening device is provided in a form of being connected to the driving shaft so as to use the driving motor as a driving source, except for a type driven by a dedicated motor. Therefore, in such a loom, the driving motor and the opening device are connected to the driving shaft. However, in the configuration of the related art, the opening device is connected to the intermediate shaft connected to the driving motor in the form described above. That is, in the configuration of the related art, the driving motor and the opening device are connected to the driving shaft via the intermediate shaft and a gear train.

The loom includes a braking device for applying a brake to the main shaft. In the configuration of the related art, the braking device is connected to the other end of the driving shaft and is configured to apply a brake to the main shaft by apply a brake to the driving shaft.

As described above, in the configuration of the related art in which the braking device is connected to an end of the driving shaft, when the brake is applied to the driving shaft to apply the brake to the main shaft, a braking force that tries to stop the rotation acts on the intermediate shaft via the gear train. When the brake is applied to the intermediate shaft as described above, the brake is also applied to the driving motor connected to the intermediate shaft and the opening device. Therefore, an inertia force due to the brake of the driving motor and the opening device acts on the intermediate shaft. Therefore, in the gear train that connects the driving shaft to which the brake is applied and the intermediate shaft that tries to rotate against the braking force by the action of the inertia force, a load corresponding to the inertia force is applied to a meshing portion between a gear on a driving shaft side and a gear on an intermediate shaft side. As a result, the gear train may be damaged.

In a case where a width dimension of the heddle frame is large as in that of a wide loom, in a case where the number of heddle frames mounted on the loom or used for weaving is large, or the like, the inertia force due to the brake of the opening device is further increased. Since the driving force of the driving motor that drives the opening device is also further increased, the inertia force in accordance with the brake of the driving motor is also further increased. Therefore, in such a case, the load applied to the gear train is further increased as described above during braking by the braking device, so that the damage thereof or the like is more likely to occur.

As a connection configuration for connecting the driving shaft and the intermediate shaft, a combination of a pulley and a timing belt can be considered in addition to the gear train. However, even in the case of the configuration, since the intermediate shaft is rotated by the inertia force with respect to the braked driving shaft, a load corresponding to the inertia force is applied to the timing belt connecting the driving shaft and the intermediate shaft. As a result, the timing belt may be damaged or the like.

SUMMARY OF THE INVENTION

Therefore, an object of the present invention is to provide a structure of a loom in which damage of the above-mentioned connection configuration can be prevented as much as possible during braking by a braking device.

To achieve the above object, the present invention provides the loom as described above, in which the driving-force transmission mechanism includes a driving-force transmission shaft that is provided so as to protrude from a side wall of the side frame while extending parallel to the driving shaft within a space of the side frame, the driving-force transmission shaft being connected to the driving motor, and to which the opening device is connected, and a transmission mechanism that connects the driving-force transmission shaft and the driving shaft, and the braking device is connected to the driving transmission shaft.

According to the loom according to the present invention, by the configuration, a load applied to the connection configuration that connects the driving shaft and the driving-force transmission shaft is small during braking by the braking device. More specifically, during the braking, the brake is applied to the driving shaft and the driving transmission shaft. Therefore, an inertia force due to the brake of connected configuration elements acts on each of the driving shaft and the driving transmission shaft. As described above, the driving-force transmission shaft is connected to the driving motor and the opening device as the configuration elements. The driving shaft is connected to the main shaft, a beating device, and the like as the configuration elements.

As in the configuration of the related art or the configuration according to the present invention, in a case of a configuration in which one or more configuration elements are connected to each other and the braking device is connected to one of two shafts connected to each other by the connection configuration, a brake is directly applied to one shaft (braking shaft) by the braking device, and thereby the other shaft (braked shaft) receives the braking force via the connection configuration. In other words, the connection configuration becomes a portion acting the braking force by the braking shaft on the braked shaft.

The inertia force due to the configuration elements acting on each shaft as the brake is applied to each shaft naturally acts in a rotational direction of the shaft. Therefore, on the braking shaft side, the inertia force acts in a direction of weakening the braking force of the braking device. Therefore, the braking force, which is acted on the connection configuration by the braking shaft, is a force weakened by the inertia force acting on the braking shaft side by the braking force that the braking device tries to act on the braking shaft. On the other hand, the inertia force acting on the braked shaft is a force against the braking force (braking force that the braking shaft acts on the connection configuration) that the braked shaft receives from the connection configuration. Therefore, the greater the inertia force acting on the braking shaft (the smaller the braking force that braking shaft acts on the connection configuration), the smaller load is applied to the connection configuration. In addition, the greater the inertia force acting on the braked shaft, (the greater the force against the braking force received from the connection configuration), the greater the load is applied to the connection configuration.

In the loom, during the braking, the inertia force acting on the shaft (driving transmission shaft) by the driving motor and the opening device is generally greater than the inertia force acting on the shaft (driving shaft) by the main shaft, the beating device, or the like. Therefore, compared with the configuration of the related art in which the driving shaft is the braking shaft, the load applied to the connection configuration during the braking is small in the configuration of the present invention in which the driving-force transmission shaft is the braking shaft. Therefore, according to the present invention, damage to the connection configuration is prevented as much as possible.

DETAILED DESCRIPTION OF THE INVENTION

Figure 1:
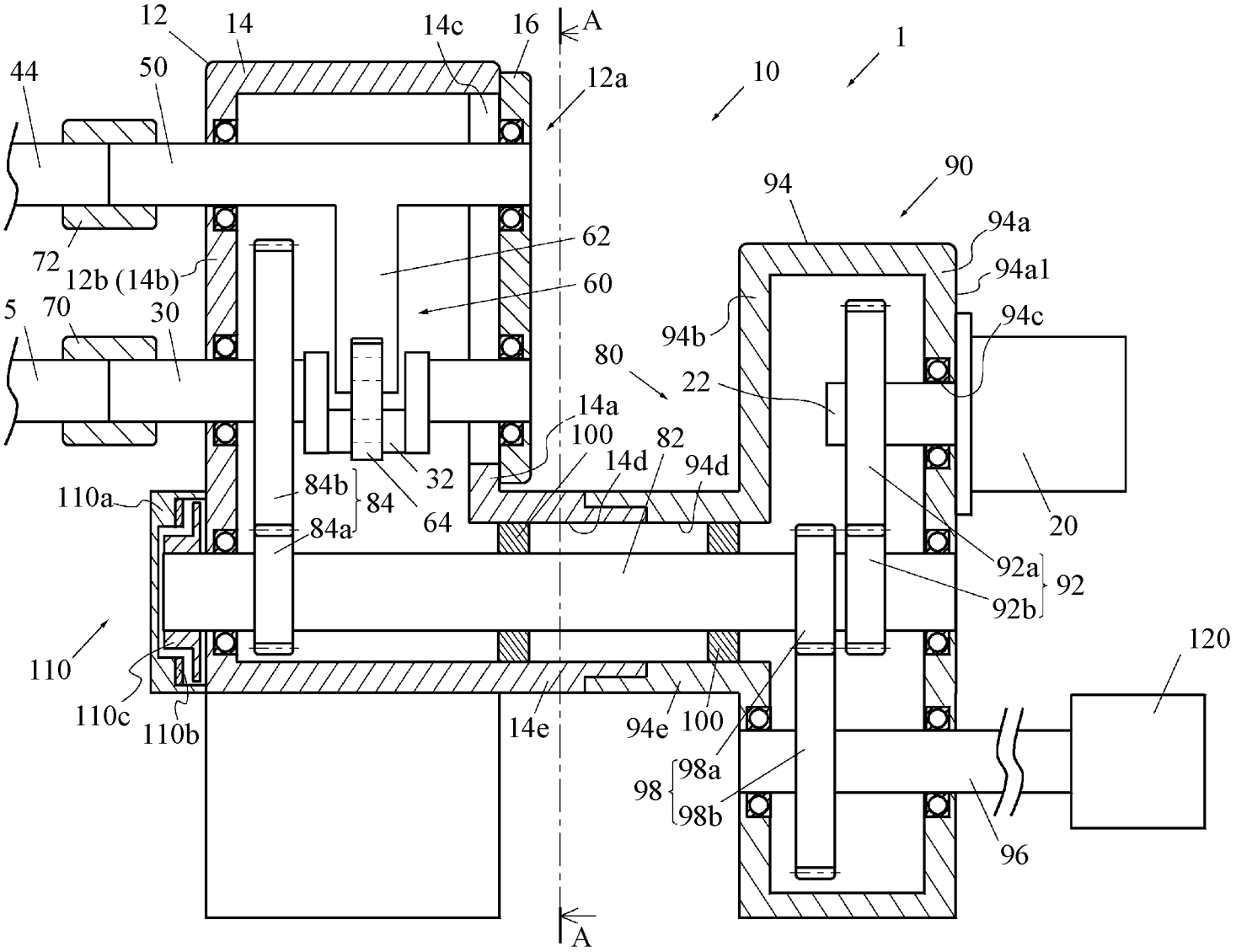
FIG. 1 is a front sectional view of a loom 1 according to an embodiment of the present invention.
Figure 2:
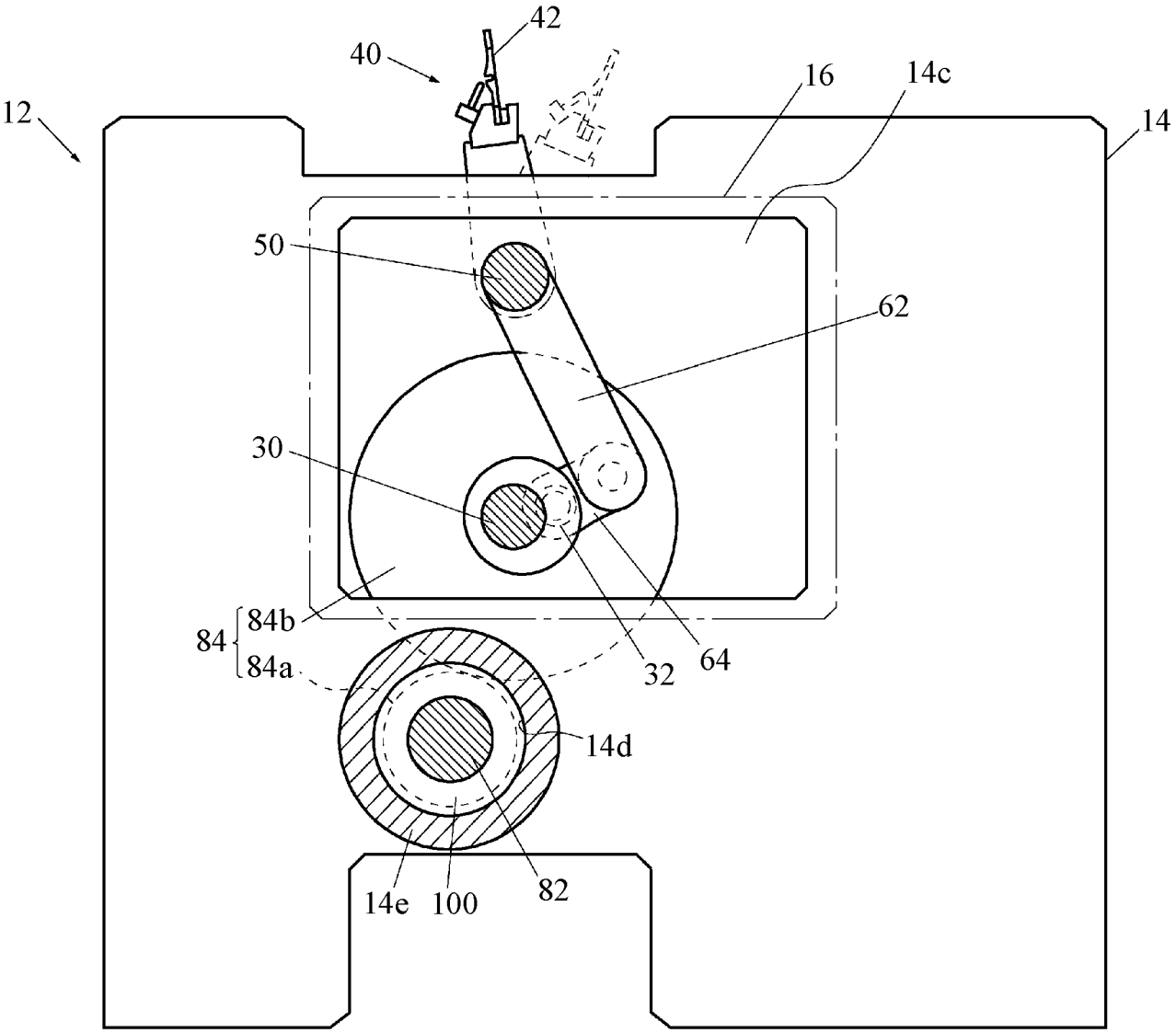
FIG. 2 is a sectional view which is taken along line A-A of FIG. 1.

Hereinafter, an embodiment (example) of a loom to which the present invention is applied will be described with reference to FIGS. 1 and 2.

In a loom 1, a frame 10 includes a pair of housing-shaped side frames 12 and 12, and the side frames 12 are configured to be connected by a plurality of beam materials. The loom 1 includes a driving motor 20, and is configured to drive a main shaft 5 of the loom 1 by the driving motor 20. The driving motor 20 is provided on one side frame 12 (hereinafter, referred to as "driving-side frame") side of the pair of side frames 12 and 12.

The driving-side frame 12 is configured of a frame body 14 that is a main portion, and a frame cover 16 attached to the frame body 14. Specifically, the frame body 14 is formed in a housing shape having a space therein, and a portion (portion corresponding to a swing mechanism 60 or the like described later in a width direction) in a side wall (outer wall portion) 14*a*, which is an outside in the width direction of the loom 1, is open. The frame cover 16 is a member formed in a plate shape, and has a size capable of covering an opened portion (opening portion) 14*c* of the frame body 14. The driving-side frame 12 is configured such that the frame cover 16 is attached to the frame body 14 in a form of covering the opening portion 14*c*. Therefore, the side wall (outer wall) 12*a* of the driving-side frame 12 that is the outside in the width direction is configured of the outer wall portion 14*a* of the frame body 14 and the frame cover 16 that covers the opening portion 14*c* thereof. The frame cover 16 is attached to the frame body 14 by using screw members (not illustrated) such as bolts, and the frame cover 16 can be attached or detached to or from the frame body 14.

The loom 1 includes a driving shaft 30 which is interposed between a driving motor 20 and a main shaft 5, is rotationally driven by the driving motor 20, and rotationally drives the main shaft 5. The loom 1 includes a swing shaft 50 for driving a locking shaft 44 to swing in a beating device 40, and a swing mechanism 60 for connecting the swing shaft 50 and the driving shaft 30. The present example is an example in which a crank mechanism is adopted as the swing mechanism 60. The driving shaft 30, the swing shaft 50, and the swing mechanism 60 are disposed to be located within a range of the opening portion 14*c* in the driving-side frame 12 as viewed in the width direction, and are accommodated in the space within the driving-side frame 12. Details of each configuration in such a loom 1 are as follows.

The driving shaft 30 is formed as a shaft having a dimension (length dimension) in an axial direction, which is larger than a dimension of the driving-side frame 12 in the width direction. However, the driving shaft 30 is a crank-shaped shaft formed as an eccentric portion 32 of which an intermediate portion is eccentric with respect to portions of both sides (both-side portions). The driving shaft 30 is rotatably supported by both side walls 12*a* and 12*b* of the driving-side frame 12 via bearings in an orientation in which the axial direction matches with the width direction, and is accommodated in the driving-side frame 12 in such a form.

The support position is located such that the driving shaft 30 is located below an intermediate portion in the opening portion 14*c* in the frame body 14 when the driving-side frame 12 is viewed in the width direction. The driving shaft 30 is supported by the frame cover 16 at one end thereof in one end side. Therefore, the driving shaft 30 is in a state where a portion including the other end is provided in a form of protruding, on the other end side, from an inner wall (inner wall portion) 14*b* of the frame body 14 in the width direction. The driving shaft 30 is supported by the inner wall portion of the frame body 14 at a portion on the driving-side frame 12 side from the protruding portion. The main shaft 5 is connected to the other end of the driving shaft 30 by a coupling member 70.

Similar to the driving shaft 30, the swing shaft 50 is formed as a shaft of which a dimension is larger than the dimension of the driving-side frame 12 in the width direction. Similar to the driving shaft 30, the swing shaft 50 is supported by the both side walls 12*a* and 12*b* of the driving-side frame 12 via bearings in the orientation parallel to the driving shaft 30, and is accommodated in the driving-side frame 12. Similar to the driving shaft 30, the support position is a position within the range of the opening portion 14*c* in the frame body 14 when the driving-side frame 12 is viewed in the width direction, and is a position above the driving shaft 30. The swing shaft 50 is also supported by the frame cover 16 at one end thereof, a portion including the other end is provided so as to protrude from the inner wall portion 14*b* of the frame body 14, and is supported by the inner wall portion 14*b* of the frame body 14 at the other end side thereof. A locking shaft 44 that supports the reed 42 is connected to the other end of the swing shaft 50 by a coupling member 72.

As described above, the swing mechanism 60 is the crank mechanism and includes a swing arm 62 which is provided so as not to rotate relative to the swing shaft 50, and a connection lever 64 which is a link for connecting the swing arm 62 and the eccentric portion 32 of the driving shall 30. In the illustrated example, the swing shaft 50 and the swing arm 62 are integrally formed. The connection lever 64 is relatively rotatably connected to the swing arm 62 and the driving shaft 30 (eccentric portion 32). In the swing mechanism 60, the driving shaft 30 is rotationally driven and the eccentric portion 32 is rotationally moved at a position eccentric from a shaft center of both-side portions, and thereby the swing arm 62 (swing shaft 50) connected to the eccentric portion 32 via the connection lever 64 is driven to swing. Therefore, in that configuration, a part of the driving shaft 30 also functions as the swing mechanism 60. As described above, the swing shaft 50 is driven to swing, and thereby the locking shaft 44 connected to the swing shaft 50 and the reed 42 supported by the locking shaft 44 move to swing, and the beating operation is performed.

In the loom 1 described above, the loom 1 includes a driving-force transmission mechanism 80 that connects the driving shaft 30 and the driving motor 20. Therefore, the driving shaft 30 connected to the main shaft 5 is rotationally driven by the driving motor 20. The driving-force transmission mechanism 80 is configured to include a driving-force transmission shaft 82 connected to the driving motor 20 and a transmission mechanism 84 connecting the driving-force transmission shaft 82 and the driving shaft 30. A braking device 110 included in the loom 1 to apply a brake to the main shaft 5 is provided to apply a direct brake to the driving-force transmission shaft 82. An opening device 120 that reciprocates a heddle frame (not illustrated) in a vertical direction uses the driving motor 20 as a driving source, and is connected to the driving-force transmission shaft 82 which is connected to the driving motor 20. Details of the loom 1 of the present example are as follows.

The driving-force transmission shaft 82 is formed as a shaft of which a dimension (length dimension) in the axial direction is larger than the dimension of the driving-side frame 12 in the width direction and is larger than the length dimension of the driving shaft 30. The driving-force transmission shaft 82 is provided to be supported by the inner wall 12*b* of the driving-side frame 12 via a bearing on one end side thereof in the orientation parallel to the driving shaft 30, and penetrate the outer wall portion 14*a* (outer wall 12*a* of the driving-side frame 12) of the frame body 14, and the other end thereof is located on the outside of the outer wall portion 14*a*. Therefore, the driving-force transmission shaft 82 is in a state where a portion between the portion supported by the bearing and the outer wall portion 14*a* is accommodated within the driving-side frame 12. However, as described above, although the driving-force transmission shaft 82 is supported by the inner wall 12*b* on the one end side, the driving-force transmission shaft 82 also protrudes from the inner wall 12*b* so that the one end is located on the outside of the inner wall 12*b*. The driving-force transmission shaft 82 provided as described above is connected to the driving shaft 30 by the transmission mechanism 84 within the driving-side frame 12.

The support position of the driving-force transmission shaft 82 is a position outside the range of the opening portion 14*c* in the frame body 14, and is a position separated downward from the driving shaft 30. In the outer wall portion 14*a* of the frame body 14, a through hole 14*d* is formed at a position corresponding to the support position to allow the driving-force transmission shaft 82 to penetrate as described above.

In the present example, the transmission mechanism 84 is configured as a gear train including two gears accommodated within the driving-side frame 12. Specifically, the transmission mechanism 84 is configured of a driving gear 84*a* attached so as not to rotate relative to the driving-force transmission shaft 82, and a driven gear 84*b* that meshes with the driving gear 84*a* and is attached so as not to rotate relative to the driving shaft 30. The position where the driving gear 84*a* and the driven gear 84*b* are attached to each shaft is a position on the inner wall 12*b* side of the driving-side frame 12 in the width direction from the connection position between the driving shaft 30 (eccentric portion 32) and the swing mechanism 60 (connection lever 64). That is, in the present example, the driving-force transmission shaft 82 and the driving shaft 30 are connected at a position on the inner wall 12*b* side of the driving-side frame 12 in the width direction from the connection position between the driving shaft 30 and the swing mechanism 60.

The driving-force transmission shall 82 is a driving mechanism 90 for rotationally driving the driving-force transmission shaft 82 on the other end side, and is connected to the driving mechanism 90 including the driving motor 20. In addition to the driving motor 20, the driving mechanism 90 includes a driving gear train 92 that connects the output shaft 22 of the driving motor 20 and the driving-force transmission shaft 82. The driving mechanism 90 is configured to have a housing-shaped driving box 94 as a base, the driving motor 20 is attached to the outer surface of the driving box 94, and the driving gear train 92 is accommodated within the driving box 94.

In the driving box 94, the driving motor 20 is attached to an outer surface 94*a*1 of one side wall 94*a* of the pair of side walls 94*a* and 94*b* facing each other, and the both side walls 94*a* and 94*b* are provided to be parallel to the outer wall 12*a* of the driving-side frame 12. The driving box 94 is provided to overlap the driving-side frame 12 in the back and forth direction of the loom 1. As described above, since the driving-force transmission shaft 82 protruding from the driving-side frame 12 is connected to the driving gear train 92 accommodated within the driving box 94, the driving-force transmission shaft 82 penetrates the other side wall 94*b* of the pair of side walls 94*a* and 94*b* in the driving box 94, and the portion of the other end side is located within the driving box 94 (accommodated in the driving box 94). Therefore, a through hole 94*d* that allows the penetration of the driving-force transmission shaft 82 is formed on the other side wall 94*b* in the driving box 94.

As described above, the driving-force transmission shaft 82 protruding from the driving-side frame 12 is supported by one side wall 94*a* in the driving box 94 via a bearing at the other end. However, the driving box 94 is provided such that the other side wall 94*b* through which the driving-force transmission shaft 82 penetrates is separated from the driving-side frame 12.

The driving motor 20 is attached to the driving box 94 by bolts or the like (not illustrated) such that the output shaft 22 is oriented toward the driving-side frame 12 side at a position separated upward with respect to the driving-force transmission shaft 82 supported as described above. A through hole 94*c* is formed on one side wall 94*a* in the driving box 94 to which the driving motor 20 is attached to allow the output shaft 22 of the driving motor 20 to penetrate at the attachment position. Therefore, as described above, in a state where the driving motor 20 is attached to the driving box 94, the output shaft 22 extends within the driving box 94 in the width direction and exists to be parallel to the driving-force transmission shaft 82. The output shaft 22 is connected to a portion of the driving-force transmission shaft 82 on the portion of the other end side of via the driving gear train 92 within the driving box 94.

Similar to the gear train 84 connecting the driving shaft 30 and the driving-force transmission shaft 82, the driving gear train 92 is configured of two gears. Specifically, the driving gear train 92 is configured of a driving gear 92*a* that is attached so as not to rotate relative to the output shaft 22 of the driving motor 20, and a driven gear 92*b* that meshes with the driving gear 92*a* and is attached so as not to rotate relative to the driving-force transmission shaft 82.

The driving mechanism 90 includes an opening shaft 96 to which the opening device 120 in the loom 1 is connected, and an opening gear train 98 that connects the driving-force transmission shaft 82 and the opening shaft 96. The opening shaft 96 is formed as a shaft having a dimension (length dimension) in an axial direction, which is larger than a dimension of the driving box 94 in the width direction. The opening shaft 96 is supported by both side walls 94*a* and 94*b* of the driving box 94 via bearings in an orientation parallel to the driving-force transmission shaft 82 at a position spaced downward with respect to the driving-force transmission shaft 82. The opening shaft 96 is provided so that one end thereof protrudes from one side wall 94*a* of the driving box 94. The opening shaft 96 is connected to the opening device 120 at the protruding one end portion thereof.

The opening shaft 96 is connected to the driving-force transmission shaft 82 via the opening gear train 98 within the driving box 94. The opening gear train 98 is configured of two gears like the driving gear train 92. Specifically, the opening gear train 98 is configured of a driving gear 98*a* attached so as not to rotate relative to the driving-force transmission shaft 82, and a driven gear 98*b* that meshes with the driving gear 98*a* and is attached so as not to rotate relative to the opening shaft 96.

The braking device 110 is an electromagnetic brake and is provided so as to directly apply a brake to the driving-force transmission shaft 82. In the present example, the braking device 110 is provided at a position inside from the inner wall 12*b* of the driving-side frame 12 in the width direction. The braking device 110 is mainly configured of a housing-shaped body case 110*a*, and is attached to the inner wall 12*b* of the driving-side frame 12 in the body case 110*a*. The braking device 110 includes a braking member 110*b* and a braked member 110*c* accommodated in the body case 110*a*, and the braked member 110*c* is disposed to be directly attached to one end (end protruding from the inner wall 12*b*) of the driving-force transmission shaft 82.

The braked member 110*c* is a disk-shaped member and is attached so as not to rotate relative to the driving-force transmission shaft 82 in a state where the driving-force transmission shaft 82 is inserted through a through hole formed in a boss portion at a center. The braking member 110*b* is urged by an urging member (not illustrated) such as a spring member in the axial direction of the driving-force transmission shaft 82 to which the braked member 110*c* is attached. In the braking device 110, a built-in exciting coil (not illustrated) is put into an excited state (or a non-excited state), so that the braking member 110*b* is configured to be displaced to a braked member 110*c* side against an urging force by the urging member. Thus, in a state where the braking member 110*b* is pressed against the braked member 110*c*, the braking device 110 applies the brake to the driving-force transmission shaft 82, and further applies the brake to the driving shaft 30, the driving motor 20, and the opening device 120 connected to the driving-force transmission shaft 82.

In the illustrated example, the frame body 14 has a protruding portion 14*e* formed to protrude from the outer wall portion 14*a* toward the driving box 94 side around the through hole 14*d* in the outer wall portion 14*a*. On the other hand, the driving box 94 also has a protruding portion 94*e* formed to protrude from the other side wall 94*b* toward the driving-side frame 12 side around the through hole 94*d* in the other side wall 94*b*. The frame body 14 and the driving box 94 are connected such that the both protruding portions 14*e* and 94*e* are fitted to each other. In spaces inside the protruding portions 14*e* and 94*e*, oil seals 100 are provided between inner peripheral surfaces of the protruding portions 14*e* and 94*e*, and the driving-force transmission shaft 82.

According to the loom 1 of the present example configured as described above, during the braking of the loom 1 (main shaft 5), since the brake is directly applied to the driving-force transmission shaft 82 by the braking device 110, the load applied to the transmission mechanism 84 that connects the driving-force transmission shaft 82 and the driving shaft 30 is smaller than that of the device of the related art.

More specifically, the braking device 110 is actuated, a braking force by the braking device 110 directly acts on the driving-force transmission shaft 82, and the brake is applied to the driving-force transmission shaft 82. When the brake is applied to the driving-force transmission shaft 82, the brake is applied to the driving shaft 30 connected to the driving-force transmission shaft 82, and the brake is also applied to the driving motor 20 and the opening device 120. The brake of the driving shaft 30 is performed in a form of the brake of the main shaft 5 and the beating device 40 connected to the driving shaft 30. For the brake of the driving shaft 30 (main shaft 5 and beating device 40), as described above, since the driving-force transmission shaft 82 and driving shaft 30 are connected via the transmission mechanism 84 (driving gear 84*a* and driven gear 84*b*), the driving gear 84*a* attached to the driving-force transmission shaft 82 acts the braking force on the driven gear 84*b* attached to the driving shaft 30.

When the braking is applied to the driving-force transmission shaft 82, an inertia force acts on the driving-force transmission shaft 82 by the inertia of the driving motor 20 and the opening device 120 to which the brake is applied accordingly. Along with this, the braking force that acts on the driven gear 84*b* by the driving gear 84*a* becomes a force having a size weakened by the inertia force of the braking force by the braking device 110 due to the action of the inertia force. That is, during the braking, in the transmission mechanism 84, the driving gear 84*a* causes the braking force of such a size to act on the driven gear 84*b*. On the other hand, when the brake is applied to the driving shaft 30, the inertia force acts on the driving shaft 30 by the main shaft 5 and the beating device 40. The inertia force acts on the driving gear 84*a* via the driven gear 84*b* as a force against the braking force in the transmission mechanism 84.

As described above, in a case where the driving-force transmission shaft 82 and the driving shaft 30 are connected by a gear train such as the transmission mechanism 84, during the braking, the gear (driving gear 84*a*) on the braking side causes the braking force to act on the gear (driven gear 84*b*) on the braked side, and the gear on the braking side receives a force against the braking force from the gear on the braked side. The greater those forces acting in this way, the greater the load is applied to the transmission mechanism 84. In the loom, the inertia force (inertia force by the driving motor 20 and the opening device 120) acting on the driving-force transmission shaft 82 with the brake is generally greater than the inertia force (inertia force by the main shaft 5 and the opening device 120) acting on the driving shaft 30. Therefore, if the loom is configured to directly brake the driving-force transmission shaft 82 having a large inertia force acting during the braking, both the above-mentioned braking force and the force against the braking force become a small force compared to that of the case of the device of the related art. Therefore, the load applied to the transmission mechanism 84 is smaller than that of the device of the related art, and as a result, the transmission mechanism 84 is prevented from being damaged as much as possible.

In the above, one embodiment (hereinafter, referred to as "the above example") of the loom to which the present invention is applied is described. However, the present invention is not limited to the configuration described in the above example, and can be implemented in other embodiments (modified examples) as described below.

(1) Regarding the connection position of the braking device with respect to the driving transmission shaft, in the above example, the connection position is inside the driving-side frame 12 in the width direction. However, in the present invention, the connection position is not limited to the inside of the driving-side frame, and may be outside. In that case, the braking device may be attached to the outer wall of the driving-side frame or attached to the side wall of the driving box.

(2) Regarding the transmission mechanism that connects the driving shaft and the driving transmission shaft, the transmission mechanism is not limited to the gear train configured of two gears of the driving gear 84*a* and the driven gear 84*b* which are accommodated within the driving-side frame 12 as in the above example. For example, the transmission mechanism may be one that is also configured of the same gear train, or may be a gear train that is configured of three or more gears. The transmission mechanism is not limited to one configured of the gear train, and may be configured to connect a pulley attached to the driving shaft and a pulley attached to the driving-force transmission shaft with a timing belt.

The configuration in which the driving motor and the opening device are connected to the driving-force transmission shaft is not limited to the gear train configured of two gears as in the above example, and as in the case of the transmission mechanism described above, the gear train may be configured of three or more gears, or may be connected by a pulley and a timing belt. As described above, in the configuration in which the driving motor and the opening device are connected to the driving transmission shaft, a configuration may be provided in which one of the driving motor and the opening device is connected to the driving-force transmission shaft via a coupling member or the like.

(3) Regarding the position where the driving shaft and the driving-force transmission shaft are connected by the transmission mechanism, in the above example, the connection position is the inner wall 12*b* side of the driving-side frame 12 with respect to the eccentric portion 32 of the driving shaft 30 in the width direction. However, the connection position may be on the outer wall 12*a* side of the driving-side frame 12 with respect to the eccentric portion 32 of the driving shaft 30 in the width direction.

(4) Regarding the swing mechanism, the above example is an example of the present invention applied to the loom in which the crank mechanism is adopted as the swing mechanism 60. In the above example, the swing arm 62 in the swing mechanism 60 is integrally formed with the swing shaft 50. However, even in the crank mechanism as in the above example, the swing mechanism may be configured such that the swing arm and the swing shaft are formed as separate members, and both are connected so as not to rotate relative to each other. The swing mechanism is not limited to the crank mechanism as in the above example, and may be a cam mechanism. In that case, the shaft to which the cam is attached becomes the driving shaft in the present invention.

Further, the present invention is not limited to the above-described embodiments, and various modifications can be made without departing from the gist of tine present invention.

What is claimed is:

1. A loom comprising:

a driving shaft to which a main shaft of the loom is connected and to which a swing shaft for driving a reed to swing is connected via a swing mechanism;

a driving motor to which the driving shaft is connected via a driving-force transmission mechanism to rotationally drive the driving shaft;

an opening device that is driven by the driving motor;

a braking device that applies a brake to the main shaft; and a side frame that accommodates the driving shaft and the swing shaft in an orientation in which each axial direction of the driving shaft and the swing shaft matches with a width direction, wherein the driving-force transmission mechanism includes a driving-force transmission shaft that is provided so as to protrude from a side wall of the side frame while extending parallel to the driving shaft within a space of the side frame, the driving-force transmission shaft being connected to the driving motor, and to which the opening device is connected, and a transmission mechanism that connects the driving-force transmission shaft and the driving shaft so as to transmit rotation of the driving-force transmission shaft by the driving motor to the main shaft via the driving shaft, and the braking device is connected to the driving-force transmission shaft.

* * * * *